US005290105A

United States Patent [19]

Tencati

[11] Patent Number: 5,290,105

[45] Date of Patent: Mar. 1, 1994

[54] CONTAINER MADE OF FLEXIBLE LAMINATED SHEET WITH INSERT FOR OPENING AND RECLOSING

[75] Inventor: Adriano Tencati, Milan, Italy

[73] Assignee: Safta S.P.A., Piacenza, Italy

[21] Appl. No.: 809,964

[22] Filed: Dec. 18, 1991

[30] Foreign Application Priority Data

Dec. 28, 1990 [IT] Italy ..... 22563 A/90

[51] Int. Cl.[5] ..... B65D 33/16; B65D 41/58

[52] U.S. Cl. ..... 383/203; 383/61; 383/96; 383/202; 215/33

[58] Field of Search ..... 383/202, 203, 80, 96, 383/61; 215/32, 35; 206/484

[56] References Cited

U.S. PATENT DOCUMENTS

| | | | |
|---|---|---|---|
| 3,858,739 | 1/1975 | Turner et al. | 215/32 |
| 4,010,786 | 3/1977 | Aguettant et al. | 383/202 |
| 4,410,096 | 10/1983 | Paradis | 215/32 |
| 4,512,475 | 4/1985 | Federighi | 206/484 |
| 4,643,309 | 2/1987 | Evers | 206/484 |
| 4,732,299 | 3/1988 | Hoyt | 383/906 X |
| 4,779,997 | 10/1988 | Schmidt | 383/96 |

FOREIGN PATENT DOCUMENTS

| | | | |
|---|---|---|---|
| 2644426 | 9/1990 | France | 383/96 |
| 677093 | 4/1991 | Switzerland | 383/80 |

*Primary Examiner*—Gary E. Elkins
*Assistant Examiner*—Jes F. Pascua
*Attorney, Agent, or Firm*—Ostrolenk, Faber, Gerb & Soffen

[57] ABSTRACT

Containers, in particular plastic bags, for limited doses of liquid, oil, cream doses, and the like, that can be easily opened and reclosed, and that are well sealed and resistant to from tearing and leakage. The container body (envelope) is formed of a thermosealable, substantially flexible composite film (laminated or coextruded). A substantially rigid insert is welded to the inside top portion of the envelope. The insert has a base, a neck with a central hole, a groove fracture part, and a knurled cap from the center of which a pin protrudes. After the insert is fractured and removed, it can be easily flipped over and reinserted in the base to reseal the envelope.

10 Claims, 4 Drawing Sheets

FIG.2a
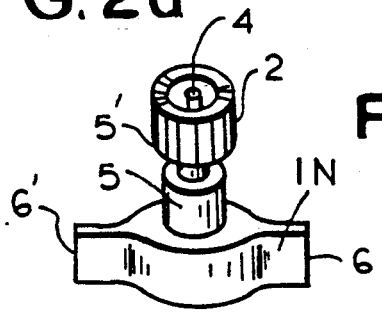
FIG.2d
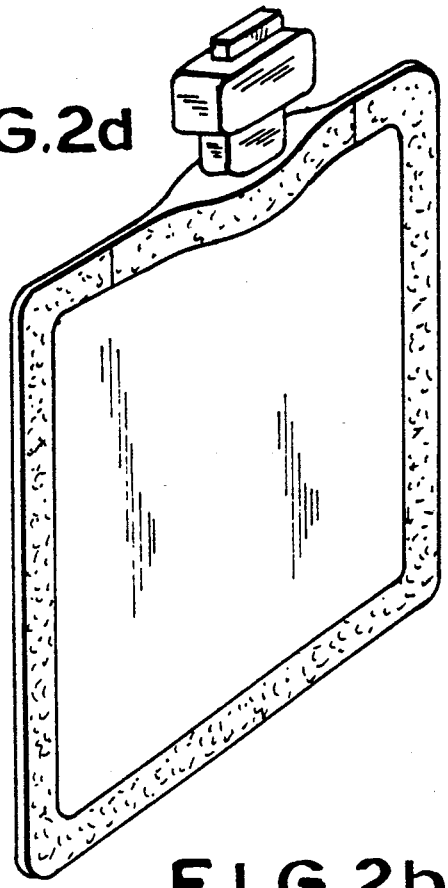
FIG.2c
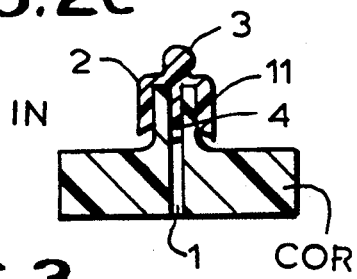
FIG.3
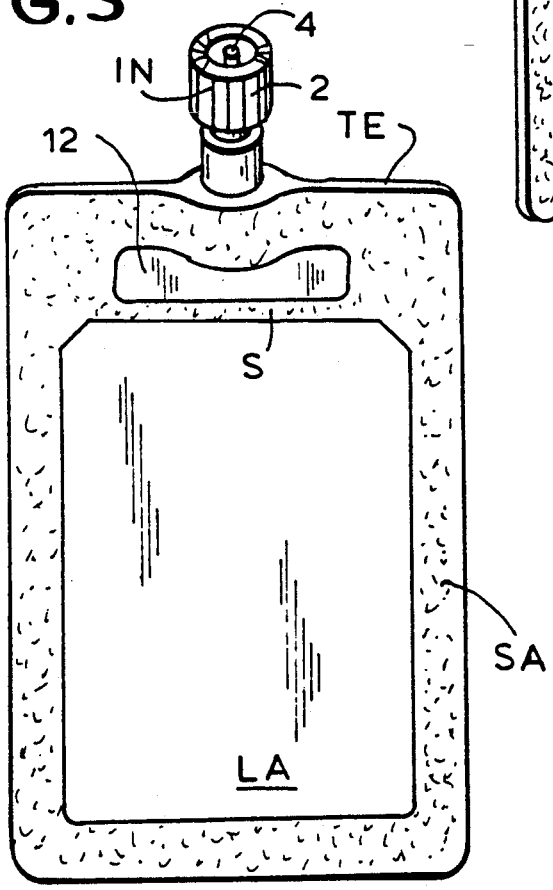
FIG.2b
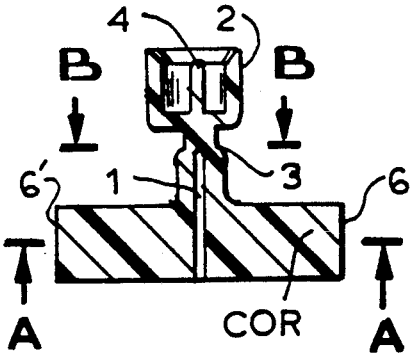
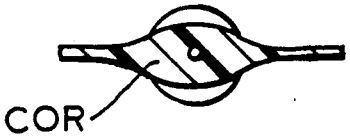
FIG.2e

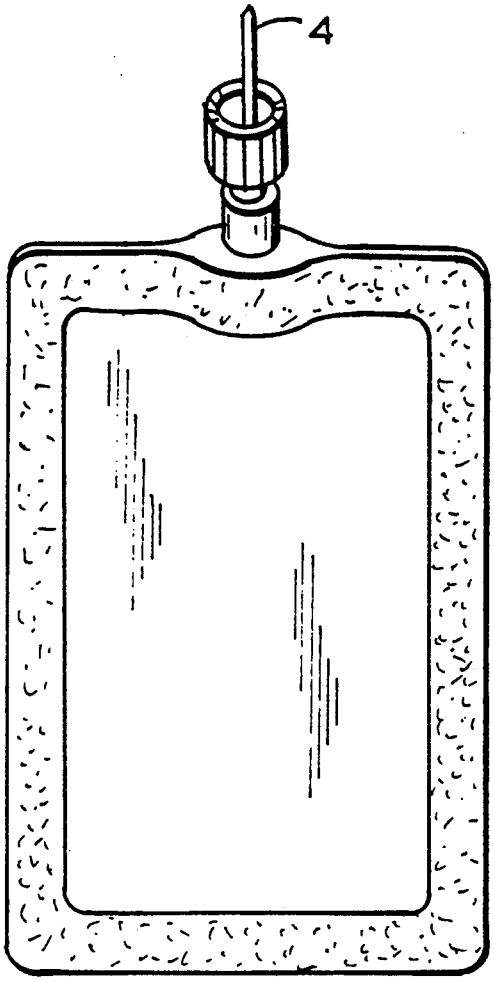
FIG.4
FIG.5
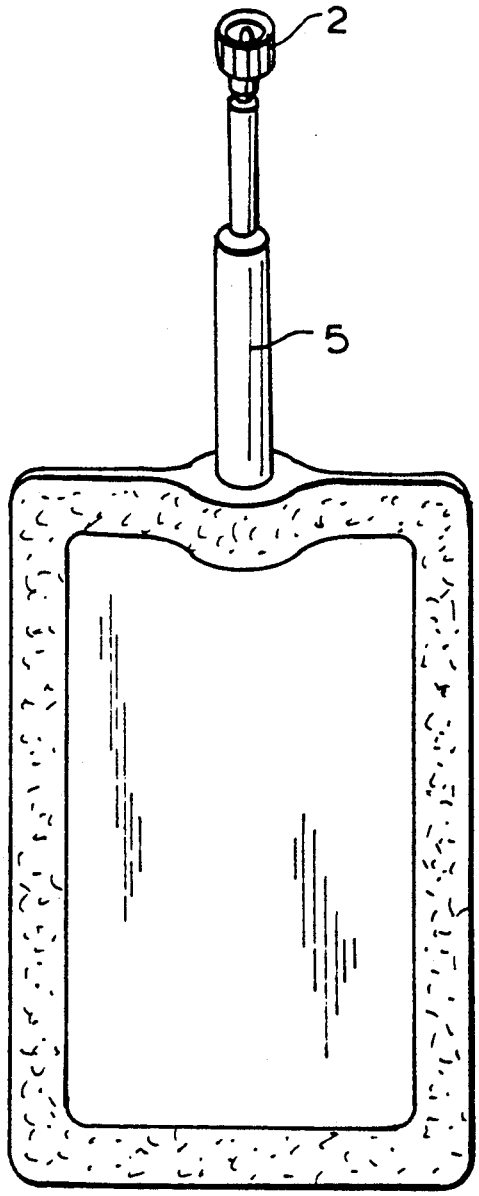
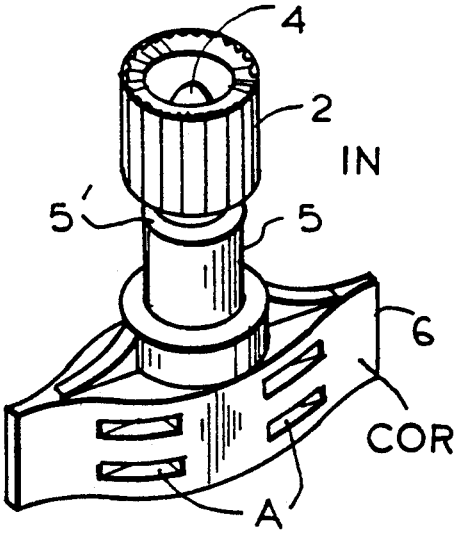
FIG.6

FIG.4b
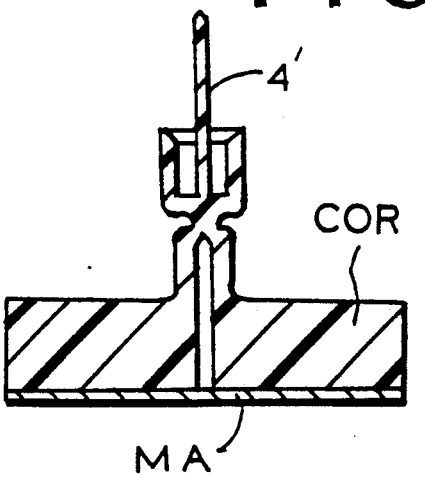
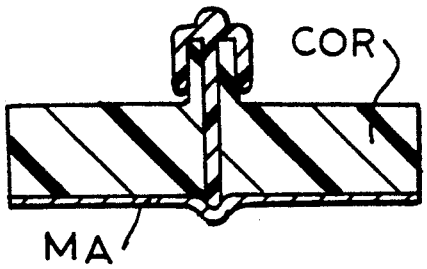
FIG.4c
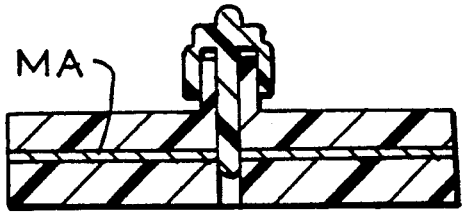
FIG.4a
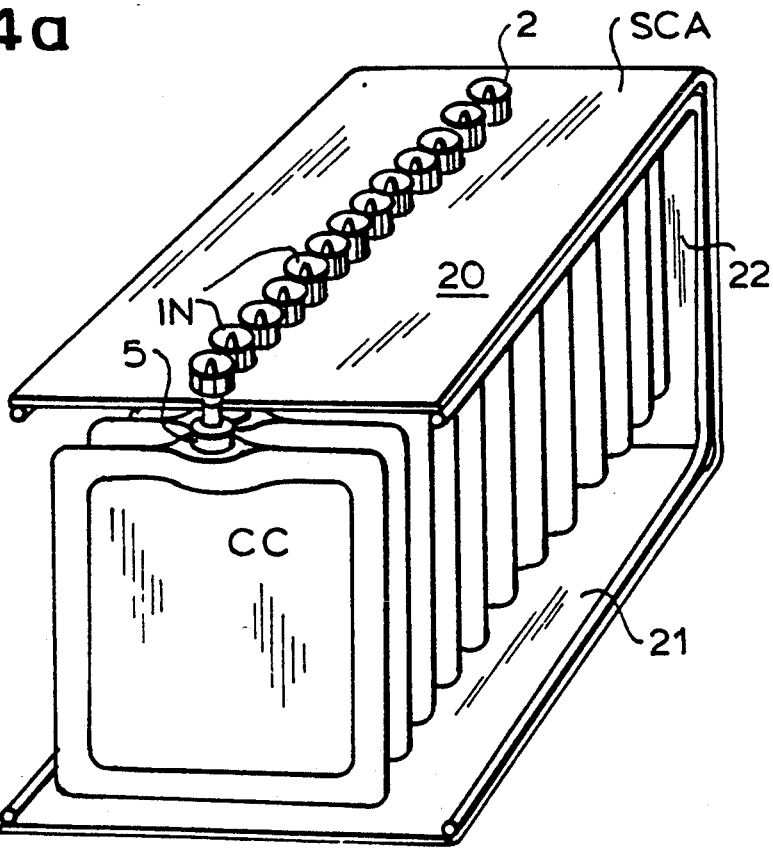
FIG.7

CONTAINER MADE OF FLEXIBLE LAMINATED SHEET WITH INSERT FOR OPENING AND RECLOSING

BACKGROUND OF THE INVENTION

1. Field of the Invention:

The present invention relates to containers, in particular plastic envelopes and bags for holding liquids, oils, creams and the like, formed of a housing body made of a thermosealable, substantially flexible laminate, within which a substantially rigid insert is secured, the insert providing easier opening and repeated reclosing of the container, while also preventing leakage of the container. More particularly, the invention relates to single or multiple dose envelopes, formed of rigid and flexible parts, the major flexible part serving as a container for doses of small liquid quantities (from single doses up to a maximum quantity of 100 ml), and the rigid part, secured to the inside top portion of the container, acting, after it has been fractured and flipped over, as a sealing and/or perforation member.

2. Description of the Related Art

Over the past few years, there has been a trend in the packaging industry toward providing containers which are easier to open and/or use by the consumer. An example of this is the proliferation of many successful packagings both in the sector of rigid packaging (e.g. dispenser for dentifrice with pump and integral dispenser) and in the sector of flexible packaging (e.g. stand-up packaging with straw and perforation aid).

A type of packaging that until today has remained substantially unchanged is an envelope for small volumes of liquids or creams, e.g. from single dose to 100 ml envelopes. Such packaging has obtained a wide success over many years in the food field and in the cosmetic and pharmaceutical fields. Some of the advantages of these types of small envelopes/bags are as follows:

- the wide selection of currently available laminates assuring a suitable protection to the product;
- remarkably practical and hygienic characteristics during use;
- the content is prebatched;
- they can be distributed in many different ways, e.g. by insertion in newspapers or magazines or coupled with other packagings, etc..

In spite of this, traditional small envelope packaging has some drawbacks:

It cannot be easily opened on one hand since the laminates for holding liquids are relatively tough, on the other hand, due to the tendency of the same sealing layer to lose its adhesion if the package content reacts with the adhesives. This phenomenon reduces the "tearing possibility" of laminates.

It cannot be reclosed. Sometimes the consumer is inclined to use the dose at different times, but the lack of possibility of closing the containers once they are opened compels the marketing division to select single dose packaging, even if this is not optimal from a marketability point of view.

Further, it must be observed that single dose packaging is, in general, a packaging undesirably subject to ambient conditions owing to the high ratio between the packaging surface and the content volume. The possibility of reclosing the packaging permits multiple dose packaging and reducing greatly this ratio and consequently the impact of ambient conditions.

The delivery occurs in a manner which is difficult to control and at locations which are difficult to pinpoint. In fact, the opening of a traditional single dose package is usually made by tearing, resulting in an opening having a variable section and frayed edges. This makes it difficult to deliver the desired quantity at the desired point.

The objective of the present invention is to provide a container system that does not have the above mentioned drawbacks and in particular does not have the drawbacks of impossible reclosing, difficult opening and limited controlled delivery, by utilizing a rigid insert suitably shaped and made of plastic material.

BRIEF DESCRIPTION OF THE DRAWINGS

Further features and advantages of the invention shall become apparent from the following description of some preferred (but not limiting) embodiments, represented in the annexed drawings, in which:

FIG. 1, 1*a*, 3, 4 and 5 are schematic and partial front views of a container supplied with the insert of the present invention;

FIG. 1*a*, 2*b*, 2*c*, 2*e*, 4*a*, 4*b*and 4*c* are schematic sectional views of a complete bag (FIG. 1*a*), and the insert; and FIGS. 2*a* and 6 are schematic perspective views of an insulated insert; and FIGS. 2*d* and 7 are perspective views, respectively, of a complete bag and of an assembly of bags packed using just the head of the insert.

DETAILED DESCRIPTION OF THE PREFERRED EMBODIMENT

Figure 1:
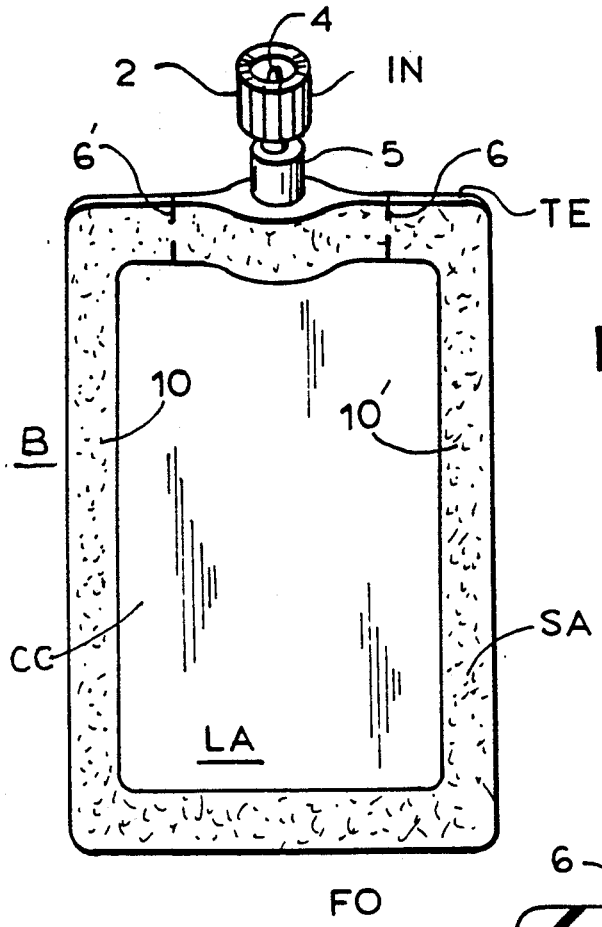

As shown in the drawings, the envelope B of the present invention includes a holding body CC, formed of a flexible composite film (laminate, coextruded film, etc.) LA, with peripheral weldings SA that extend from the bottom OF to the top TE and along the sides 10, 10'.

According to a feature of the invention, the top of the envelope TE includes therein substantially rigid insert IN including a base body COR having a central bulge (FIGS. 2*a*, 2*c*, 2*b*), a neck 5 with hole 1, a fracture groove portion 3, and a knurled cap 2, from the center of which a sealing and optionally perforating pin 4 protrudes.

The end sides of the base COR are indicated by 6, 6'.

FIG. 3 represents a cross welding S located under a unwelded zone 12 of the holding body CC.

Figure 1A:
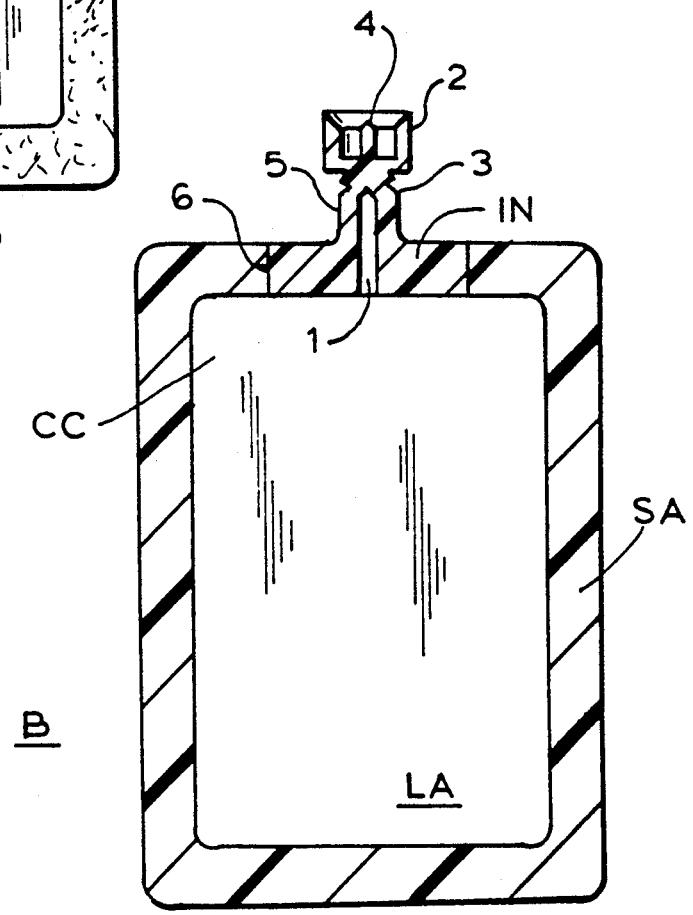

According to a feature of the invention, the insert is applied during the packaging phase and is joined to the envelope to assure a perfect liquid seal (FIGS. 1, 1*a*and 2*a*). Preferably, the insert has a structural configuration, e.g. as shown in FIGS. 2*a*, 2*b* and 2*c*, so that:

It presents a surface orthogonal to the welding pressure in front of the welders (not represented) (FIG. 2, section A—A).

It is preferably fractured by torsion (FIG. 2, section B—B) thus facilitating opening, the torsion being applied manually on the cap 2;

It is possible to use the detached portion of the insert as a cap to reclose the packaging. As shown in FIG. 2*c*, to reclose the container, the detached part II of IN is flipped 180° over, the pin 4 inside the cap 2 contributing to increase the sealing surface, thus assuring perfect resealing of the packaging (FIG. 2*c*).

Barrier. The wide variety of products contained in actual single dose packagings requires the use of laminates having barrier properties that can be also very high, which is often accomplished by using aluminum laminated sheets.

In the case of an envelope coupled with the insert of the present invention, the total barrier of the packaging is limited by the permeability of the insert, which can be insufficient in the fracture section (FIG. 2, section B—B). This is the case for products particularly sensible to atmospheric gases or of products based on particularly volatile perfumes. In these cases, it is possible to foresee various alternative solutions: FIG. 3 illustrates an embodiment in which the contained product is confined in the lower part (total barrier) by a welding S that is opened by applying lateral pressure on the envelope.

FIG. 4*b* shows how the problem is solved by welding an aluminum membrane MA, that is not yet fractured in FIG. 4, to the base of insert IN. To open this type of envelope, the pin 4' of the cap, that in this case has an elongated form, is inserted into the opening 1 and pushed until it breaks the membrane MA (FIG. 4*c*).

In yet another embodiment, the proposed membrane MA is integral with the body COR of the insert IN, e.g. during the manufacture phase of said insert (FIG. 4*a*), such that the membrane is broken when the insert is removed.

INSERT. The insert can have a wide range of different shapes. The "do-it-yourself" sector of the packaging industry considers as suitable a shape as shown in FIG. 5 for an envelope holding small quantities of oil or manufacturing grease. In this case, the neck 5 is particularly long.

FIG. 6 shows an insert type with enlarged neck 2 and groove A made in the body COR for adjusting the elasticity or rigidity. FIG. 7 shows how a suitable insert (as e.g. in FIG. 6) can be used for compactly and aesthetically locating a series of many bags SA in a single display rack, e.g. of box-type SCA, hanging the parts 5' intermediate between the neck 5 and the cap 2 of inserts IN to the cover 20 of SCA.

These inserts can be advantageously used as various suspension, alignment and support means of the containers CC that can be also laid with its lower end on the bottom wall 21 of the box SCA. Therefore, the transport, presentation, stock, extraction, etc. of bags with inserts can be made easier. Also, the openings, grooves, engravings A of the body COR can have a suitable structure and shape.

The material. The selection of plastic material forming the insert is made with the aim of obtaining:

- high chemical integrity for avoiding interactions with the content;
- withstanding thermal treatments that must be applied to the packaging;
- easy fracture in the insert zone; and
- cheap fabrication process.

These considerations lead to a reduction of the selection field to the more common resins used in injection molding, in particular to the polyolefins, such as polyethylene (PE), polypropylene (PP), etc.; in particular cases, polyethyleneglycol-teraphthalate (PETP), "surlyn" or Barex can be used. Finally, as the plastic insert, together with the laminated sheet bobbin, must enter a packaging system, they can be fed by single piece or from a roll (cartridge-belt).

LAMINATED SHEET. As already mentioned, the selection of materials for forming the envelope body is rather wide. Among the more common transparent structures, the following ones are preferred: PETP+PE; PETP+PP; PETP+EVAL+PE; −PETP+EVAL+PP; among the double or triple laminates based on metallized (m) sheets, e.g.:

−PETP+mPETP+PE and finally the more common laminates based on aluminum sheets (ALU):

−PETP+ALU+PE; −PETP+ALU+PP; −ALU+PETP+PE; −ALU+PETP+PP;

and many other ones, always however having the property of welding compatibility with the insert.

The packaging equipment can be an equipment to be installed on existing packaging machines. This equipment makes the following operations:

- Drawing of the plastic insert from a proper dispenser;
- Positioning of the insert into the envelope opening, after its filling;
- Releasing the assembled unit after welding; and
- If necessary, conveying of the packaging along the output line.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A reclosable envelope container, comprising:

(a) a body formed of two thermosealable, substantially flexible composite films, said films having edges heat sealed together, said body having a bottom, two sides and a top; and (b) a substantially rigid insert heat sealed between said two films along the top of said body at a location substantially central to and spaced from the two sides of said body, said insert comprising:

(i) a base having a longitudinal axis parallel to the top of said body, a central bulge extending laterally with respect to said longitudinal axis of the base and an aperture extending centrally through said central bulge in a direction perpendicular to said longitudinal axis of the base and parallel to said two sides of said body;

(ii) a neck extending upward from said base in said perpendicular direction, said neck having a central aperture aligned with the aperture of said base;

(iii) a portion of reduced diameter above said neck adapted to fracture upon the application of torsional force; and (iv) a hollow cap having a knurled outer surface and a pin which extends centrally upward within the hollow of said cap, said pin having a length substantially equal to a height of said neck and being of a diameter so as to snugly fit within the aperture of said base and seal said envelope after said portion of reduced diameter has been fractured and said cap has been removed, flipped over 180°, and placed back over said neck.

2. A reclosable envelope container as recited in claim 1, wherein said base of said insert is provided with a plurality of grooves extending in a direction parallel to the longitudinal axis of said base and said top of the body.

3. A reclosable envelope container as recited in claim 1, wherein said films are formed from a material selected from the group consisting of: (i) polyethyleneglycol teraphthlate and polyethylene; (ii) polyethyleneglycol teraphthlate and polypropylene; (iii) polyethyleneglycol teraphthlate and ethyl vinyl alcohol and polyethylene; and (iv) polyethyleneglycol teraphthlate and ethyl vinyl acetate and polypropylene.

4. A reclosable envelope container as recited in claim 1, wherein said flexible composite films include a metallized sheet layer.

5. A reclosable envelope container, as recited in claim 1, wherein said flexible composite films include a metallized sheet layer.

6. A reclosable envelope container, as recited in claim 1, wherein said insert is formed of an injection molded polyolefin material selected from the group consisting of polyethylene, polypropylene and polyethyleneglycol teraphthlate.

7. A reclosable envelope container as recited in claim 1, wherein the sides of said flexible composite films of said body are heat sealed together at the top of said body, along sides of said base.

8. A reclosable envelope container as recited in claim 7, wherein said membrane is attached to a bottom of said base.

9. A reclosable envelope container as recited in claim 7, wherein said membrane is disposed within said base.

10. A reclosable envelope container, comprising:

(a) a body formed of two thermosealable, substantially flexible composite films, said films having edges heat sealed together, said body having a bottom, two sides and a top;

(b) a substantially rigid insert heat sealed between said two films along the top of said body at a location substantially central between the two sides of said body, said insert comprising:

(i) a base having a longitudinal axis parallel to the top of said body, a central bulge extending laterally with respect to said longitudinal axis of the base and an aperture extending centrally through said central bulge in a direction perpendicular to said longitudinal axis of the base and parallel to said two sides of said body;

(ii) a neck extending upward from said base in said perpendicular direction, said neck having a central aperture aligned with the aperture of said base;

(iii) a portion of reduced diameter above said neck adapted to fracture upon the application of torsional force; and (iv) a hollow cap having a knurled outer surface and a pin which extends centrally upward within the hollow of said cap, said pin being of a diameter so as to snugly fit within the aperture of said base and seal said envelope after said portion of reduced diameter has been fractured and said cap has been removed, flipped over 180°, and placed back over said neck; and (c) said base having a membrane, said pin of said insert being of sufficient length to pass through said base and pierce said membrane after said portion of reduced diameter has been fractured and said cap has been removed, flipped over 180°, and placed back over said neck.

* * * * *